US005286556A

United States Patent [19]

Tesch

[11] Patent Number: 5,286,556

[45] Date of Patent: Feb. 15, 1994

[54] FIBER AGGREGATES SERVING AS SHAPED MATERIALS OR FILLERS FOR TEXTILES SUCH AS BEDSPREADS, GARMENTS OR THE LIKE, SHAPED MATERIALS AND FILLERS CONSISTING OF A PLURALITY OF SUCH FIBER AGGREGATES, TEXTILES CONTAINING THIS FILLER MATERIAL

[76] Inventor: Gunter Tesch, Avenue Jean-Marie-Musy 15, Fribourg, Switzerland, CH-1700

[21] Appl. No.: 842,187

[22] PCT Filed: Jul. 18, 1991

[86] PCT No.: PCT/EP91/01353

§ 371 Date: May 18, 1992

§ 102(e) Date: May 18, 1992

[87] PCT Pub. No.: WO92/01626

PCT Pub. Date: Feb. 6, 1992

[30] Foreign Application Priority Data

Jul. 18, 1990 [CH] Switzerland ..... 02374/90-3

[51] Int. Cl.[5] ..... D04H 1/58

[52] U.S. Cl. ..... 428/288; 5/482; 428/68; 428/76; 428/224; 428/297; 428/369; 428/375; 428/394

[58] Field of Search ..... 428/288, 297, 224, 85, 428/68, 76, 92, 369, 375, 394; 5/482

[56] References Cited

U.S. PATENT DOCUMENTS

| | | | |
|---|---|---|---|
| 4,065,599 | 12/1977 | Nishiumi et al. | 428/402 |
| 4,297,404 | 10/1981 | Nguyen | 428/85 |
| 4,333,976 | 6/1982 | Okamoto et al. | 428/85 |
| 4,413,030 | 11/1983 | Tesch et al. | 428/85 |
| 4,618,531 | 10/1986 | Marcus | 428/283 |
| 4,668,553 | 5/1987 | Scott et al. | 428/92 |
| 4,820,574 | 4/1989 | Tesch | 428/234 |
| 4,859,516 | 8/1989 | Yamanaka et al. | 428/92 |
| 4,952,265 | 8/1990 | Yamanaka et al. | 156/167 |

FOREIGN PATENT DOCUMENTS

| | | |
|---|---|---|
| 0257658 | 3/1988 | European Pat. Off. . |
| 2301913 | 3/1989 | Fed. Rep. of Germany . |

*Primary Examiner*—James J. Bell
*Attorney, Agent, or Firm*—Bacon & Thomas

[57] ABSTRACT

A shaping-material or filler for textiles such as bedspreads, garments or the like is disclosed consisting of a large number of fiber aggregates of a maximum length of 50 mm each. The fiber aggregates are smaller and softer than down in nature and essentially all the fibers are crimped with the fibers of the individual fiber aggregates being arranged randomly inside each aggregate. A filler is created thereby which is especially suitable for textiles such as bedspreads, or garments such as jackets, coats or the like with, the filler being enclosed in an envelope. This filler can be made to vary in thickness with surface distribution, in the manner known for fiber balls and down. However, the filler has little shift, even if the textile is vigorously shaken, and nevertheless, is very soft. A method for manufacturing the textile is also described.

13 Claims, 3 Drawing Sheets

Figure 1:
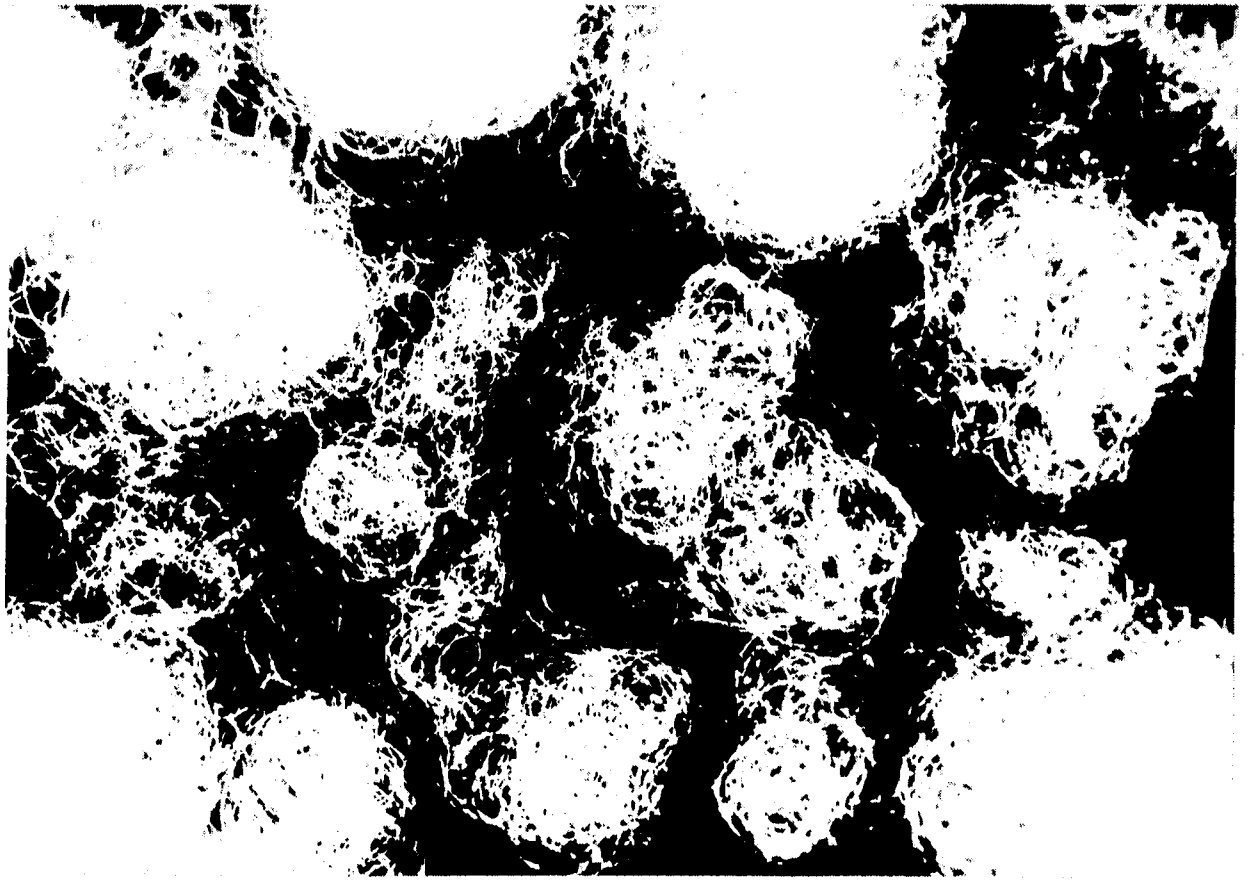

FIBER AGGREGATES SERVING AS SHAPED MATERIALS OR FILLERS FOR TEXTILES SUCH AS BEDSPREADS, GARMENTS OR THE LIKE, SHAPED MATERIALS AND FILLERS CONSISTING OF A PLURALITY OF SUCH FIBER AGGREGATES, TEXTILES CONTAINING THIS FILLER MATERIAL

DESCRIPTION

The invention pertains to fiber aggregates for use as shaped materials or fillers for textiles such as bedspreads, garments or the like. In addition, the present invention pertains to a shaped material or filler consisting of a plurality of such fiber aggregates, along with a method for making the textile.

STATE OF THE ART

Fillers for textiles such as bedspreads, garments or the like are widely known.

For centuries, bedspreads have been filled with down, feathers, animal hair and the like. Down fillers are very pleasant to use, being lightweight and providing good thermal insulation. However, down-filled bedspreads and garments are highly expensive.

Other fillers such as feathers or animal hair, such as camel-hair, are also known and are more economical than down, but are also harder than down.

Attempts have long been made to manufacture a down-like product consisting of synthetic fibers.

Illustratively, a ball of fibers is disclosed in U.S. Pat. No. 4,065,599, which consists of spherically wound synthetic fibers. Essentially the fibers are arranged in a spherical shell with comparatively few fibers being present at the sphere center. By heat treatment, the fibers of this fiber ball are bonded to each other, so that a durable and stiff fiber ball is achieved.

German patent document B 2,301,913 discloses a filler consisting of shaped materials which are round in cross-section. This filler is made of fiber aggregates with individual filaments at least 200 nm long being used to manufacture the individual aggregates. These filaments are separated from each other by a gas jet and blown into a vessel having a perforated wall and are collected therein. The filaments are then rotated by means of a gas jet blown eccentrically into the vessel, thereby causing the filaments to form a spherical shaped fiber ball with spherically wound fibers. Each fiber ball evinces a higher density away from its center, with preferably no fibers being present at the center. Synthetic fibers such as polyamide, polyester, polyacrylic acid, polyvinyl alcohol, polyvinylidene chloride, polyurethane and polyvinyl chloride are used to form such fiber balls. However various synthetic fibers which differ in their thermoplastic properties also may be mixed.

Because the synthetic filaments bond at their contact points, these known fiber balls cannot hook into or penetrate each other. Even though such a fiber ball evinces similar properties to down when used as a filler, especially the characteristics of bulk, compressibility, softness, thermal insulation, low weight and good conformance to the body being enveloped, the fiber ball nevertheless incurs the drawback that the individual balls will easily shift inside a pillow or a bedspread. This is especially disadvantageous for bedspreads and garments because when such a textile is shaken or moved in some other way, the fiber balls shift inside the cover and, with time, few or even no balls will be left in some areas of the textile. This results in cold areas, wherein the material no longer insulates.

U.S. Pat. No. 4,618,531 also discloses a polyester fiber ball serving as a filler, of which the fibers are spirally crimped. For these fiber balls, only very few fibers project beyond the ball surface. Therefore, the cohesion between the balls made by the method defined in this patent is about 6 Newtons. Therefore, the fiber balls can easily shift relative to each other. If such fiber balls are used as fillers, they will shift when pressure is applied to a particular spot in the filler mass. For example, when such a filler is used in a bedspread, shaking of the bedspread will result in zones or areas with a lot of fiber balls and other zones with few or no fiber balls. In the latter zones, there will be cold areas because of the lack of sufficient filler.

Such fiber balls therefore are poorly suited for bedspreads or the like, wherein the balls should be loose, but may shift because of their properties.

To prevent excessive shifting in textiles such as bedspreads, garments and the like, such textiles as a rule will be quilted. Quilting offers the advantage of various zones being filled with different quantities of fillers. Illustratively the foot zone of a bedspread may contain more filler than the center. Such filling variations are impossible, however, when using fiber webs for instance.

Repeated attempts have been made to achieve a down substitute by using fiber balls with spherically tangled fibers as the filler. That is, fiber aggregates have been used, for which the fibers essentially exhibit a spherical surface. The object was to endow the filler with a bulging property.

Further textiles are known, such as bedspreads and garments, wherein the filler is in the form of layers of fiber-webs. Over time, the thickness of such filler webs diminishes and then the textiles evince properties which are much different from textiles which are filled with down. In addition, it has been impossible to make textiles with varying thicknesses over their surface in a simple manner as is possible with the use of fiber balls.

PROBLEM

The object of the invention is to provide fiber aggregates which may serve as a shaping material or filler; which can vary in thickness over the surface; which will not substantially shift even when the object filled with such aggregates is strenuously shaken; and which, moreover, is soft. Furthermore, such a shaping or filler material should minimize the possibility of gaps between the individual fiber aggregates and, for the same weight, has more bulk. The invention provides a textile created using this filler, as well as a method for making such a material.

INVENTION

The above problem is solved by the fiber aggregates of the present invention as described herein by the shaping material and filler comprising these aggregates, by the textile material comprising this filler and by the method for making the textile material.

As opposed to the known fiber balls consisting of spherically wound fibers, the particular fiber aggregates of the invention are smaller and softer than down, with essentially all the fibers being crimped and the fibers of the individual fiber aggregates being randomly oriented inside the aggregate.

The smaller and softer than down fiber aggregates of the invention are highly susceptible; that is, the individual fibers are easily pulled out and easily fit (as compared with the known fiber balls) to other fiber aggregates, whereby substantially no gaps are left between the aggregates. The density of the aggregates is less than that of known fiber balls, and accordingly a larger volume is achieved for a given weight.

A textile material filled with such a fiber-aggregate filler, for instance a bedspread, a garment or the like, is substantially softer when compared with a bedspread filled with known fiber balls of spherically wound fibers. Inside the shaping material or filler, the fibers are cohesive, whereas such a bedspread or garment can be used without the fiber aggregates significantly shifting, which prevents the formation of cold-shunts where there is a lack of filler. Moreover, textiles filled with these new fiber aggregates are highly planar at their surfaces, which is generally impossible for materials filled with known fiber balls of spherically wound fibers.

In one embodiment of the invention, the fibers inside the individual fiber aggregates are randomly arranged while, the outer layer of the fiber aggregate is wound spherically. Relative to the overall diameter of the fiber aggregate, this outer layer is fairly thin. Depending on the kind of fiber being used, and as shown in the Table below, the filler softness can be raised even more. In addition, the susceptibility of the fiber aggregates can be somewhat lessened and hence their handling can be improved.

Furthermore, the fibers and fiber ends in the outer layer of the individual fiber aggregates are spherically wound. As a result, the individual fiber aggregates adhere to one another even better.

The individual fiber aggregates of the filler evince inherent cohesion properties and they also cohere among each other.

The fiber aggregates have lengths up to 15 mm, preferably 4 to 10 mm long. The titer of the fibers comprising these fiber aggregates is 2 to 10 dtex and preferably they are 30 to 60 mm long. Preferred fiber materials on one hand are synthetic fibers of fairly small titers, for instance 4 to 6 den, and they are strongly crimped, even three-dimensionally.

Another preferred fiber material is animal hair, especially camel hair and cashmere. The fiber aggregates of the invention can be made from under-hair that was shed from coarse, long hair, from such animals. Again such hair can be crimped. If long, coarse hair is utilized, it is may be used in combination with the under-hairs. The long coarse hair also preferably shall be artificially crimped before manufacturing the fiber aggregate.

Such long, coarse hairs partly project from the individual fiber aggregates and brace the fiber aggregates among each other, so that a large, elastic bulk is provided.

In one embodiment of the invention, the fiber aggregate consists of a mixture of fine and coarse fibers. The proportion of coarse fibers in the fiber mixture may be 2 to 20%.

However, the fiber mixture also may consist of fine and coarse synthetic fibers which are artificially crimped.

The cohesion of the individual fiber aggregates within and between themselves may be reinforced further by bonding the fiber aggregates to one another with binders. Such binders may be thermoplastic, surface-fused fibers, such as cladded-core fibers or the like.

When a large number of such fiber aggregates are used together, for instance for textiles such as bedspreads, garments or the like, the fiber aggregates of the filler cohere among each other. This cohesion can be reinforced by using binders to further bond the fiber aggregates to each other.

A filler according to the invention is especially well suited for such textiles as bedspreads, in particular garments and the like, where the filler is enveloped within a cover.

For example, a shaping material or filler according to the invention composed of these new fiber aggregates may be manufactured by filling the aggregates into a cavity mold corresponding to the shaped body which is desired. The shaped body is subjected to a temperature that surface-fuses the binding fibers which is then cooled and removed from the mold. Following surface-fusing, the fibers are linked to other fibers at their intersections, and a stable, durable shaped body is achieved which essentially consists of fibers connected to one another in three dimensions.

The invention also concerns a method for making a textile having two outer faces such as a bedspread or a garment wherein fiber aggregates of the filler are deposited on one of the outer faces of the envelope of the textile, and the other outer face of the envelope is laid on the deposited fiber aggregates. The two envelope parts are then connected at least at their edges, preferably being stitched and quilted. The new fiber aggregates can be deposited on a track, such as a conveyor belt.

In a special implementation of the method of the invention, the textile is divided into individual chambers at sites distributed over its surface and is quilted.

The particular chambers of the textile are filled, particularly with more filler than corresponds to their own volume. For instance, an amount of filler having a volume prior to compression from the textile envelope of 1.3 times that of the chamber may be put into such a chamber.

In this method, natural fibers, including naturally occurring long, coarse hairs, can be used as the fibers of the invention. Those natural fibers may be artificially crimped.

Further advantages and particulars of the invention will become more fully apparent below in relation to illustrative implementations.

The softness of various fillers is measured in control tests as follows:

A constant amount of 30 g of the particular filler is put into a cylinder and by means of a plunger is loaded first at a pressure of 0.25 g/cm$^2$ and a second time with a pressure of 2 g/cm$^2$. The volume difference that is measured is stated as a degree of softness in the Table below. At the same time the material density in the unstressed state is also measured.

TABLE

| Fiber orientation | Type of Fiber | Density g/10 ltr | softness cm$^3$/30 g |
|---|---|---|---|
| random | camel hair | 100 | 740 |
| | polyester fiber, 4,4 dtex | 82 | 800 |
| internally random, outside wound spherically | camel hair | 93 | 860 |
| | polyester fiber 4,4 dtex | 85 | 760 |
| Compared with: | camel hair | 145 | 300 |

TABLE-continued

| Fiber orientation | Type of Fiber | Density g/10 ltr | softness $cm^3/30$ g |
|---|---|---|---|
| wound spherically into a fiber ball | polyester fiber 4,4 dtex | 105 | 450 |

The table shows that while maintaining the fiber constant, the softness of the fiber aggregates having a random fiber orientation is substantially higher than that of fiber balls with spherically wound fibers.

If the fiber aggregates with internal randomly arranged fibers furthermore are spherically enclosed by a few fibers, then the softness of the filler further increases for camel hair, whereas it becomes less for polyester fibers with 4.4 dtex. At the same time, the density of the camel-hair filler decreases while that of the polyester fibers increases.

Whereas heretofore attempts were made to produce an especially stable fiber ball of spherically wound fibers, said fiber ball being quite stiff, the filler of the invention on the other hand creates a very soft material which is better suited for bedspreads and garments that the known fiber balls.

The table below shows the geometries of the fiber aggregates used in accordance with the present invention, with the aggregates of the invention made of camel hair and polyesters (in particular for bedspreads), compared with known fiber balls made of spherically wound fibers (for pillows and bedspreads).

TABLE

| Fiber orientation and type of fiber | density g/10 ltr | mean titer dtex | mean aggregate weight mg | fiber length per aggregate m* | aggregate diameter mm |
|---|---|---|---|---|---|
| Inside fibers are randomly arranged, outside they are wound spherically (INVENTION) | | | | | |
| camel hair | 85 | 5.5 | 1.2 | 3 | 3.8 |
| polyester | 95 | 4.8 | 2 | 4 | 4.6 |
| Wound spherically into a ball | | | | | |
| aggregate for bedspreads | 105 | 4.8 | 3 | 6 | 5.3 |
| pillow aggregate | 115 | 6.7 | 4 | 5 | 5.9 |

*sum of all the fiber lengths of one aggregate

The table shows that the smaller and softer than down fiber aggregates of the present invention, having randomly arranged fibers, not only evince lower densities than known spherically wound fiber balls, but furthermore have smaller diameters and hence less fiber material is required.

The enclosed graph compares the smaller and softer than down fiber aggregates of the invention with randomly arranged fibers to known fiber balls of spherically wound fiber aggregates with respect to the relative filling volume when both kinds of fiber aggregates are located in an envelope, for instance in bedspreads. The pressure p exerted by the fiber aggregates on the envelope is along the y-axis. The x-axis represents the relative filling volume $V_F/V_H$, that is, the ratio of the volume $V_F$ of the uncompressed fiber aggregates outside an envelope to the volume $V_H$ within the envelope. A relative filling volume of 1 indicates that the envelope volume $V_H$ is exactly the volume $V_F$ of the filler fiber aggregates in the uncompressed state.

Accordingly, up to a relative filling volume of 1 (that is, a volume of fiber aggregates if filled into the envelope which is less than or up to this envelope volume), both the fiber aggregates of the invention and the known fiber balls will not exert pressure on the envelope.

If, for instance, as suggested within the scope of the present invention, a quantity of fiber aggregates is put into the envelope of which the "compression-free" unloaded volume $V_F$ is 1.3-fold the envelope volume $V_H$, then the pressure p exerted by the fiber aggregates on the envelope and by the envelope on the fiber aggregates will be far higher for the known balls (curve K) than for the fiber aggregates of the invention (curve E).

The slopes of the two curves may be viewed in the light of the hardness of an object, for instance a bedspread or a garment, filled with the fiber aggregates. In this sense, it is clear that an object filled with the known fiber balls (curve K) is much harder when slightly "overfilling" the envelope than in the case when the object is filled with the new fiber aggregates (curve E).

Moreover, the above relative filling volume also applies when considering that, in use, a filled envelope will be compressed. In other words, the quantity of fiber aggregates remains constant while the envelope volume is reduced. This is the case when a pressure, for instance an external compression force, is applied on a bedspread or garment. The fiber aggregates of the invention (curve E) are far more compressible than the known fiber balls (curve K).

With the known fiber balls, the pressure increases sharply as the relative filling volume increases (curve K), but with the fiber aggregates of the invention (curve E), the pressure rises sharply only after a much higher degree of filling has been reached because then the volume of air gradually approaches zero and the individual fibers are against each other.

Because of the lower density of the fiber aggregates of the invention, less material and hence less weight is needed at an equal volume for the filler. As already mentioned, the fiber aggregates must exert a pressure against the envelope, but nevertheless the fiber aggregates of the invention offer softer fillings because the force required to compress them is less than for the known fiber balls.

The fiber aggregates of the invention also allow far more deformation than the known fiber balls. Since known fiber balls resist such deformation, they have a higher tendency to shift in a filler consisting of a large number of fiber aggregates as compared to those of the invention, because the known fiber balls attempt to evade deformation.

Furthermore, since long coarse hairs are used and crimped, they will not pierce the envelope, for instance the envelope of a bedspread. Because of this piercing, it has been required to remove the long, coarse animal hairs before processing. However, in the present invention, these fibers assume a significant role for the fiber aggregates.

The attached photographs show aggregate embodiments with 5× magnification.

FIG. 1 shows known fiber aggregates with polyester fibers wound solely spherically into fiber balls.

Figure 2:
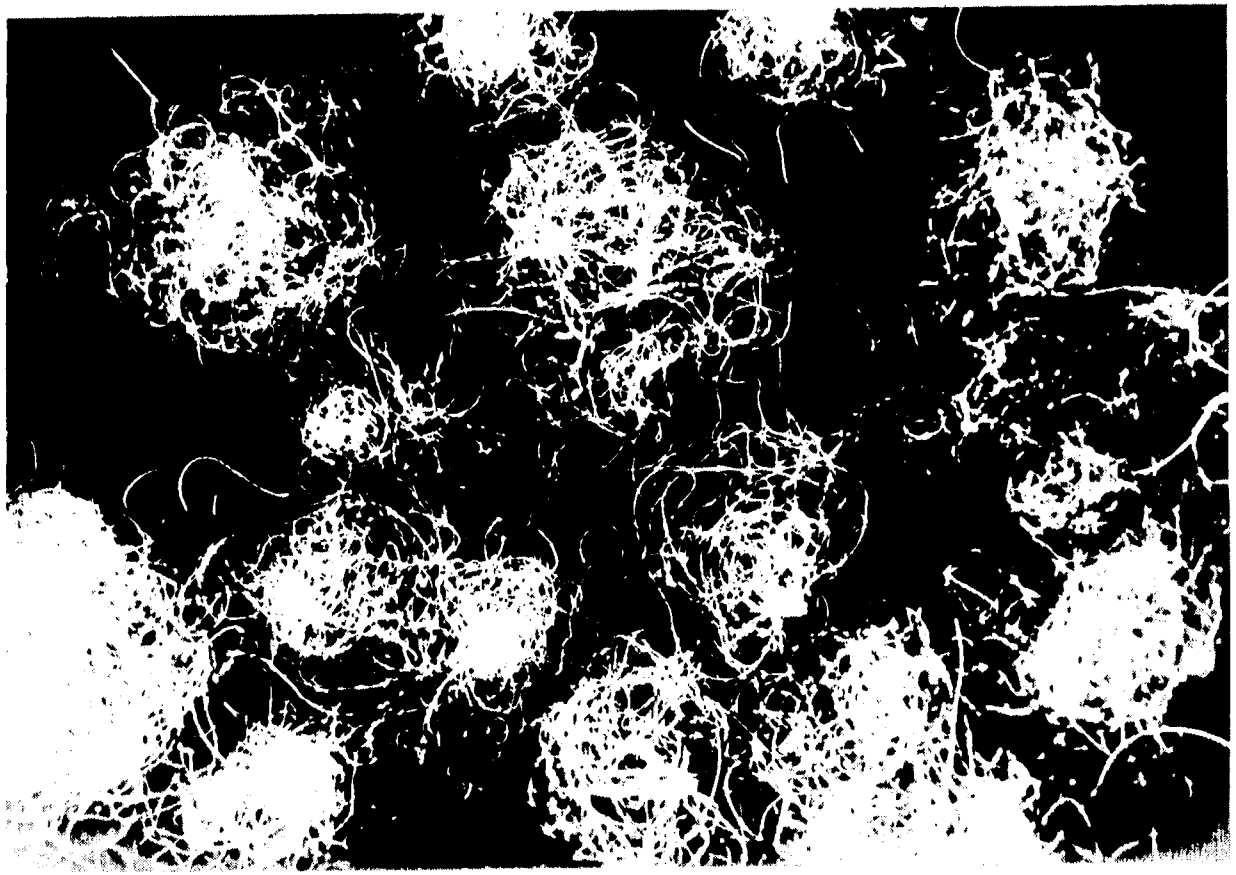
Figure 3:
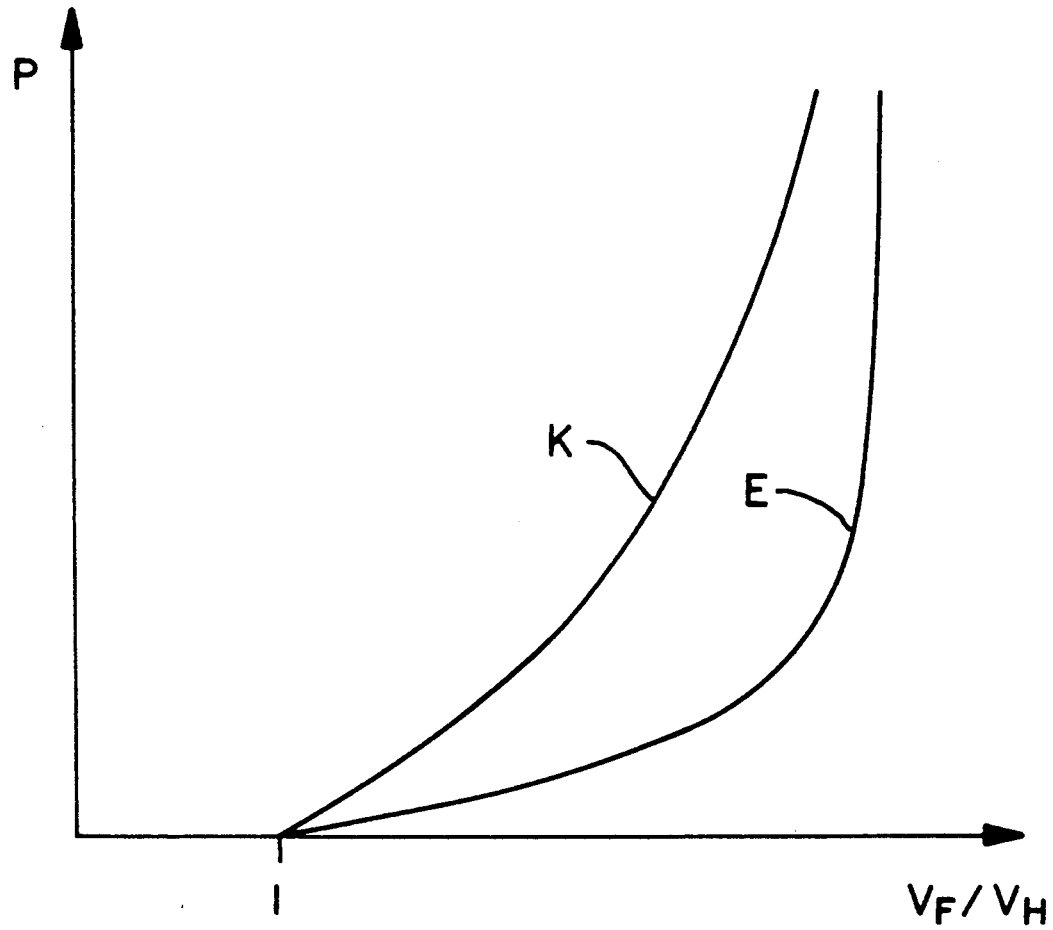

FIG. 2 shows camel-hair fiber aggregates according to the present invention. It is clear that the diameters of the fiber aggregates of the invention are smaller. Moreover, they are on the whole "airier," that is, relative to the volumes of the individual aggregates, they contain fewer fibers than the known fiber balls.

I claim:

1. Fiber aggregates for use as fillers for textiles such as bedspreads, garments or the like comprising: individual fiber aggregates having a maximum length of 50 mm, the fiber aggregates being smaller and softer than down, in that essentially all fibers are crimped and wherein the fibers of each individual fiber aggregate are randomly arranged therein and the fibers consist of a mixture of fine and coarse fibers.

2. Fiber aggregates as defined in claim 1, characterized in that the fibers inside the individual aggregates are arranged randomly but are arranged spherically in an outer layer of each fiber aggregate.

3. Fiber aggregates as defined claim 1, characterized in that the fibers and fiber ends in the outer layer of the individual fiber aggregates are spherically wound.

4. Fiber aggregates as defined in claim 1, characterized in that the fiber aggregate evinces intrinsic internal cohesion.

5. Fiber aggregates as defined in claim 4, further including binding fibers affixed to fibers of this aggregate to enhance the intrinsic, internal cohesion.

6. Fiber aggregates as defined in claim 1, characterized in that each fiber-aggregate length is a maximum of 15 mm, but preferably between 4 and 10 mm, and in that the fibers of the fiber aggregate are in the range of 30 to 60 mm long.

7. Fiber aggregates as defined in claim 1, characterized in that the proportion of the coarse fibers in the fiber mixture is in the range of 2 to 20%.

8. Fiber aggregates as defined in claim 1, characterized in that the fibers in the fiber aggregate are synthetic fibers.

9. Fiber aggregates as defined claim 1, characterized in that the fibers in the fiber aggregate are animal hairs.

10. Fiber aggregates as defined in claim 9, characterized in that the animal-hair fibers in the fiber aggregate include underhair and long, coarse hair, the long, coarse hair being artificially crimped.

11. A shaping-material or filler for textiles such as bedspreads, garments or the like, and consisting of a large number of fiber aggregates defined in claim 1, the maximum length of the individual fiber aggregate being 50 mm, characterized in that the fiber aggregates of the shaping-material or filler evince mutual cohesion.

12. A shaping-material or filler as defined in claim 11, characterized in that the fiber aggregates are bonded together by binding fibers.

13. Textiles such as bedspreads, garments or the like, with a filler defined in claim 11 and consisting of a large number of fiber aggregates and held in an envelope.

* * * * *